US009422685B2

(12) United States Patent
Lambrakos et al.

(10) Patent No.: US 9,422,685 B2
(45) Date of Patent: Aug. 23, 2016

(54) TRUSS SPAR VORTEX INDUCED VIBRATION DAMPING WITH VERTICAL PLATES

(71) Applicant: TECHNIP FRANCE, Courbevoie (FR)

(72) Inventors: Kostas F. Lambrakos, Houston, TX (US); Bonjun Koo, Katy, TX (US)

(73) Assignee: TECHNIP FRANCE, Courbevoie (FR)

( * ) Notice: Subject to any disclaimer, the term of this patent is extended or adjusted under 35 U.S.C. 154(b) by 0 days.

(21) Appl. No.: 14/420,620

(22) PCT Filed: Sep. 13, 2013

(86) PCT No.: PCT/US2013/059698

§ 371 (c)(1),
(2) Date: Feb. 9, 2015

(87) PCT Pub. No.: WO2014/043496

PCT Pub. Date: Mar. 20, 2014

(65) Prior Publication Data

US 2015/0218769 A1 Aug. 6, 2015

Related U.S. Application Data

(60) Provisional application No. 61/701,876, filed on Sep. 17, 2012.

(51) Int. Cl.

| | |
|---|---|
| ***E02B 17/00*** | (2006.01) |
| ***B63B 39/00*** | (2006.01) |
| ***B63B 35/44*** | (2006.01) |

(52) U.S. Cl.

CPC ..... *E02B 17/0017* (2013.01); *B63B 35/4413* (2013.01); *B63B 39/005* (2013.01); *B63B 2035/442* (2013.01); *E02B 2017/0073* (2013.01); *E02B 2017/0095* (2013.01)

(58) Field of Classification Search

CPC ..... E02B 17/0017

See application file for complete search history.

(56) References Cited

U.S. PATENT DOCUMENTS 6,206,614 B1 * 3/2001 Blevins ..... B63B 35/4413 114/264
6,309,141 B1 * 10/2001 Cox ..... B63B 35/4406 166/359

(Continued)

FOREIGN PATENT DOCUMENTS

GB 1580910 A 12/1980
WO 9614473 A1 5/1996

OTHER PUBLICATIONS

Szekely, Z., copy of Written Opinion for International Patent Application No. PCT/US2013/059698, European Patent Office, dated Nov. 25, 2013.

(Continued)

*Primary Examiner* — Tara M. Pinnock
(74) *Attorney, Agent, or Firm* — Jackson Walker L.L.P.

(57) ABSTRACT

The disclosure provides a system and method of reducing vortex induced vibration (VIV) with a plurality of tangentially disposed side plates having an open space on both faces transverse to a current flow of water. The side plates cause water separation around the plates with transverse VIV movement of the platform caused by the current flow against the platform, and the tangential side plates resist the VIV movement of the platform from the current. The side plates can be disposed tangentially around a periphery of an open truss structure below the hull of a spar platform. In another embodiment, the tangential side plates can be disposed tangentially away from a periphery of a hull to form a gap with an open space between the plates and the hull.

15 Claims, 10 Drawing Sheets

(56) References Cited

U.S. PATENT DOCUMENTS

| | | | | |
|---|---|---|---|---|
| 6,953,308 | B1 | 10/2005 | Horton | |
| 8,251,005 | B2 * | 8/2012 | Caracostis | B63B 35/4413 114/243 |
| 2008/0044235 | A1 * | 2/2008 | Horton | B63B 35/4406 405/224.2 |

OTHER PUBLICATIONS

Szekely, Z., copy of International Search Report for International Patent Application No. PCT/US2013/059698, European Patent Office, dated Nov. 25, 2013.

* cited by examiner

TRUSS SPAR VORTEX INDUCED VIBRATION DAMPING WITH VERTICAL PLATES

CROSS REFERENCE TO RELATED APPLICATIONS

This international patent application claims the benefit of priority to U.S. Provisional Application No. 61/701,876, filed Sep. 17, 2012.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

1. Field of the Invention

The disclosure relates to a system and method for reducing vibrations on floating platforms for drilling and production. More particularly, the disclosure relates to a system and method to reduce vortex-induced vibrations for a floating platform, such as a spar offshore platform.

2. Description of the Related Art

Offshore oil and gas drilling and production operations typically involve a platform, sometimes called a rig, on which the drilling, production and storage equipment, together with the living quarters of the personnel manning the platform, if any, may be mounted. Floating offshore platforms are typically employed in water depths of about 500 ft. (approximately 152 m) and greater, and may be held in position over the well site by, as examples, mooring lines anchored to the sea floor, motorized thrusters located on the sides of the platform, or both. Although floating offshore platforms may be more complex to operate because of their movement in response to environmental conditions, such as wind and water movement, they are generally capable of operating in substantially greater water depths than are fixed platforms. There are several different types of known floating platforms, such as, for example, so-called "drill ships," tension-leg platforms (TLPs), semi-submersibles, and spar platforms.

Spar platforms, for example, comprise long, slender, buoyant hulls that give them the appearance of a column, or spar, when floating in an upright, operating position, in which an upper portion extends above the waterline and a lower portion is submerged below it. Because of their relatively slender, elongated shape, they have relatively deeper drafts, and hence, substantially better heave characteristics, e.g., much longer natural periods in heave, than other types of platforms. Accordingly, spar platforms have been thought by some as a relatively successful platform design over the years. Examples of spar-type floating platforms used for oil and gas exploration, drilling, production, storage, and gas flaring operations may be found in the patent literature in, e.g., U.S. Pat. No. 6,213,045 to Gaber; U.S. Pat. No. 5,443,330 to Copple; U.S. Pat. Nos. 5,197,826; 4,740,109 to Horton; U.S. Pat. No. 4,702,321 to Horton; U.S. Pat. No. 4,630,968 to Berthet et al.; U.S. Pat. No. 4,234,270 to Gjerde et al.; U.S. Pat. No. 3,510,892 to Monnereau et al.; and U.S. Pat. No. 3,360,810 to Busking.

While spar offshore platforms are inherently less prone to heave because of their length, improvements in heave and motion control have been made by attaching horizontally disposed plates to the bottom of the spar hull and at times radially extending plates around the circumference of the hull. The horizontal plates have a significant width and length in an X-Y axis and a relatively small height in a Z-axis orthogonal coordinate system with the Z-axis being vertical along the length of the spar platform, as the spar is normally disposed during offshore use. U.S. Pat. No. 3,500,783 to Johnson, et al., discloses radially extending fins from the hull with a heave plate at the bottom of the hull, in that vertically and radially extending damping plates are circumferentially spaced around the upper and lower submerged portions of the platform and a horizontal damping plate is secured to the bottom of the platform to prevent resonance oscillation of the platform. Further improvements to heave control of the spar have been made by extending the spar length with open structures below the hull, such as trusses, and installing horizontally disposed plates in the open structures. The open structure of the truss allows water to be disposed above and below the surface of the horizontal plate, so that the water helps dampen the vertical movement of the spar platform.

Despite their relative success, current designs for spar platforms offer room for improvement. For example, because of their elongated, slender shape, they can be relatively more complex to manage during offshore operations under some conditions than other types of platforms in terms of, for example, control over their trim and stability. In particular, because of their elongated, slender shape, spar platforms may be particularly susceptible to vortex-induced vibration (VIV) or vortex induced motion (VIM) (herein collectively, "VIV"), which may result from strong water currents acting on the hull of the platform.

More specifically, VIV is a motion induced on bodies facing an external flow by periodical irregularities of this flow. Fluids present some viscosity, and fluid flow around a body, such as a cylinder in water, will be slowed down while in contact with its surface, forming a boundary layer. At some point, this boundary layer can separate from the body. Vortices are then formed, changing the pressure distribution along the surface. When the vortices are not formed symmetrically around the body with respect to its midplane, different lift forces develop on each side of the body, thus leading to motion transverse to the flow. VIV is an important cause of fatigue damage of offshore oil exploration and production platforms, risers, and other structures. These structures experience both current flow and top-end vessel motions, which give rise to the flow-structure relative motion. The relative motion can cause VIV "lock-in". "Lock-in" occurs when the reduced velocity, $U_{rn}$, is in a critical range depending on flow conditions and can be represented according to the formula below:

$$1<U_r=uT_n/D<12 \text{ where:}$$

$U_r$: Reduced velocity based on natural period of the moored floating structure u: Velocity of fluid currents (meters per second)

$T_n$: Natural period of the floating structure in calm water without current (seconds)

D: Diameter or width of column (meters)

Stated differently, lock-in can occur when the vortex shedding frequency becomes close to a natural frequency of vibration of the structure. When lock-in occurs, large-scale, damaging vibrations can result.

The typical solution to VIV on a spar platform is to provide strakes along the outer perimeter of the hull. The strakes are typically segmented, helically disposed structures that extend radially outward from the hull in two or more lines around the hull. Strakes have been effective in reducing the VIV. Examples are U.S. Pat. No. 6,148,751 to Brown et al., for a "system for reducing hydrodynamic drag and VIV" for fluid-submersed hulls, and U.S. Pat. No. 6,244,785, to Richter et al., for a "precast, modular spar system having a cylindrical open-ended spar." Further, U.S. Pat. No. 6,953,308 to Horton discloses strakes that radially extend from the hull and radially extending horizontal heave plates. A significant improvement in strake design is shown in WO 2010/030342 A2 for a spar hull that includes a folding strake that can be deployed for example at installation. However, strakes can be labor intensive, and difficult to install and transport undamaged to an installation site of the spar platform.

A different alleged solution to vortex induced forces and motion is disclosed in U.S. Publ. No. 2009/0114002 where surface roughness on a bluff body decreases vortex induced forces and motion, and can be applied to flexible or rigid cylinders, such as underwater pipelines, marine risers, and spar offshore platforms.

There remains a need for improved and more efficient reduction in VIV for floating platforms.

BRIEF SUMMARY OF THE INVENTION

The disclosure provides an efficient system and method of reducing vortex induced vibration (VIV) with a plurality of tangentially disposed side plates having an open space on both faces of the side plates transverse to a current flow of water against the side plates. In at least one embodiment, the side plates can be disposed tangentially around a periphery of an open truss structure below the hull of a spar platform for a volume of water to be disposed therebetween. In another embodiment, the side plates can be disposed tangentially away from a periphery of a hull to form a gap with an open space between the plates and the hull for a volume of water to be disposed therebetween. In each embodiment, the side plates cause water separation around the plates when movement of the platform occurs from VIV movement of a transverse current and the side plates resist the VIV movement of the platform in the current. The method and system of side plates can be used alone or in combination with more traditional radially extending strakes and radial plates.

The disclosure provides a system for reducing vortex-induced-vibration (VIV) in an offshore platform, comprising: a hull of the offshore platform; a truss of the offshore platform configured to be at least partially submerged below a surface of water, the water having a current flow; and one or more side plates tangentially coupled around a periphery of the truss, the hull, or both, the side plates forming an open space for water on both sides of the plates that is transverse to the current flow, the tangential side plates being configured to cause water separation around the side plates when the offshore platform moves transversely to the current flow and reduce VIV in the offshore platform by at least 20% of a VIV in the offshore platform without the tangential side plates.

The disclosure also provides a system for reducing vortex-induced-vibration (VIV) in an offshore platform, comprising: a hull of the offshore platform having a diameter; a truss of the offshore platform configured to be at least partially submerged below a surface of water, the water having a current flow; and one or more tangential side plates tangentially coupled around a periphery of the truss, the hull, or both, the side plates forming an open space for water on both sides of the plates that is transverse to the current flow, the tangential side plates being configured to cause water separation around the plates when the offshore platform moves transversely to the current flow, the side plates being sized for a width of at least 5% of the diameter and a length of at least 15% of the diameter.

The disclosure further provides a method for reducing vortex-induced-vibration (VIV) in an offshore platform, having a hull; a truss of the offshore platform configured to be at least partially submerged below a surface of water, the water having a current flow; and one or more tangential side plates tangentially coupled around a periphery of the truss, the hull, or both, the tangential side plates forming an open space for water on both sides of the plates that is transverse to the current flow, comprising: separating water flow over one or more edges of the side plates when the offshore platform moves transversely relative to the current flow; generate resistance to the transverse motion on the truss, the hull, or both with the water separation; and reducing the VIV in the offshore platform by at least 20% of a VIV in the offshore platform without the plates.

DETAILED DESCRIPTION

Figure 1A:
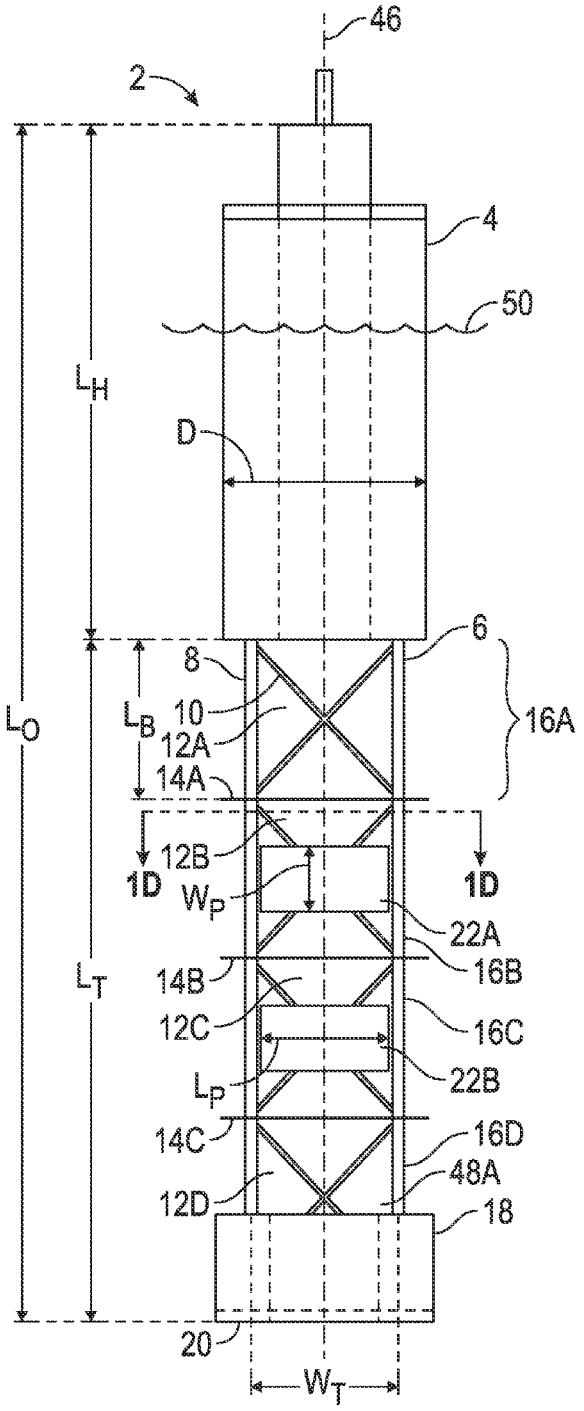
FIG. 1A is a schematic front view of an offshore platform with at least one tangential side plate in a lateral orientation coupled to a truss of the platform and configured to reduce vortex-induced vibration (VIV), according to the disclosure herein.

The Figures described above and the written description of specific structures and functions below are not presented to limit the scope of what Applicant has invented or the scope of the appended claims. Rather, the Figures and written description are provided to teach any person skilled in the art how to make and use the inventions for which patent protection is sought. Those skilled in the art will appreciate that not all features of a commercial embodiment of the inventions are described or shown for the sake of clarity and understanding. Persons of skill in this art will also appreciate that the development of an actual commercial embodiment incorporating aspects of the present inventions will require numerous implementation-specific decisions to achieve the developer's ultimate goal for the commercial embodiment. Such implementation-specific decisions may include, and likely are not limited to, compliance with system-related, business-related, government-related and other constraints, which may vary by specific implementation, location, and from time to time. While a developer's efforts might be complex and time-consuming in an absolute sense, such efforts would be, nevertheless, a routine undertaking for those of ordinary skill in this art having benefit of this disclosure. It must be understood that the inventions disclosed and taught herein are susceptible to numerous and various modifications and alternative forms. The use of a singular term, such as, but not limited to, "a," is not intended as limiting of the number of items. Also, the use of relational terms, such as, but not limited to, "top," "bottom," "left," "right," "upper," "lower," "down," "up," "side," and the like are used in the written description for clarity in specific reference to the Figures and are not intended to limit the scope of the invention or the appended claims. Where appropriate, some elements have been labeled with an alphabetic character after a number to reference a specific member of the numbered element to aid in describing the structures in relation to the Figures, but is not limiting in the claims unless specifically stated. When referring generally to such members, the number without the letter is used to encompass the members labeled with alphabetic characters. Further, such designations do not limit the number of members that can be used for that function.

The disclosure provides an efficient system and method of reducing vortex induced vibration (VIV) with a plurality of tangentially disposed side plates having an open space on both faces of the side plates transverse to a current flow of water against the side plates. In at least one embodiment, the side plates can be disposed tangentially around a periphery of an open truss structure below the hull of a spar platform for a volume of water to be disposed therebetween. In another embodiment, the side plates can be disposed tangentially away from a periphery of a hull to form a gap with an open space between the plates and the hull for a volume of water to be disposed therebetween. In each embodiment, the side plates cause water separation around the plates when movement of the platform occurs from VIV movement of a transverse current and the side plates resist the VIV movement of the platform in the current. The method and system of side plates can be used alone or in combination with more traditional radially extending strakes and radial plates.

Figure 1B:
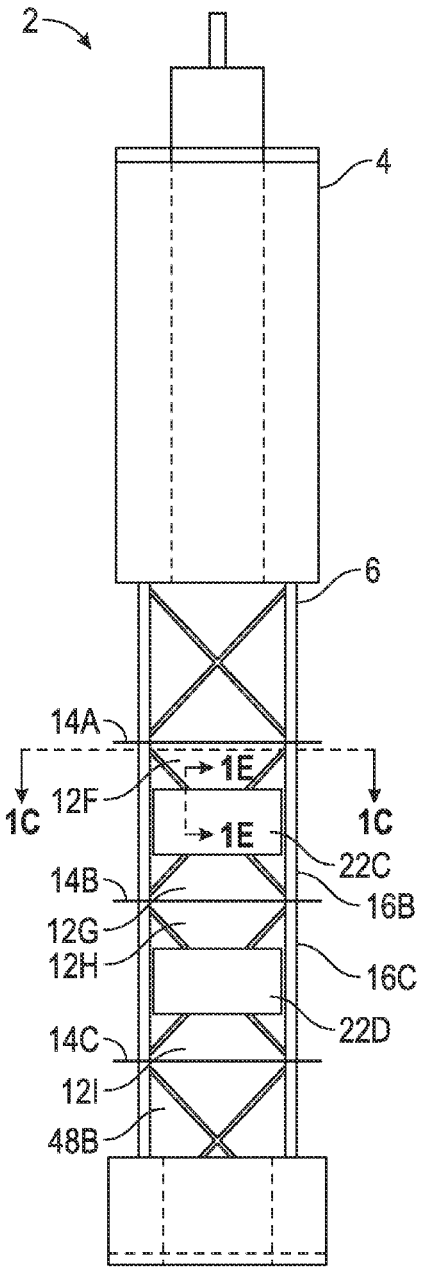
FIG. 1B is a schematic side view of the offshore platform shown in FIG. 1A with at least one side plate.
Figure 1C:
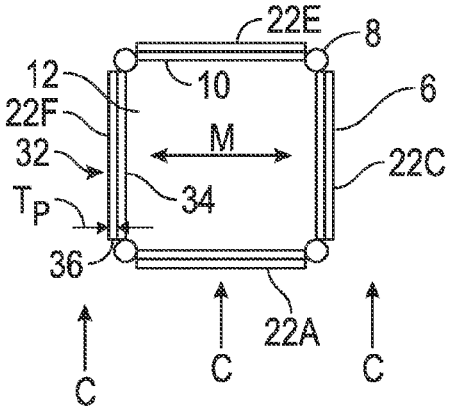
FIG. 1C is a schematic top cross sectional view of the offshore platform with the tangential side plates coupled to the truss of the offshore platform.
Figure 1D:
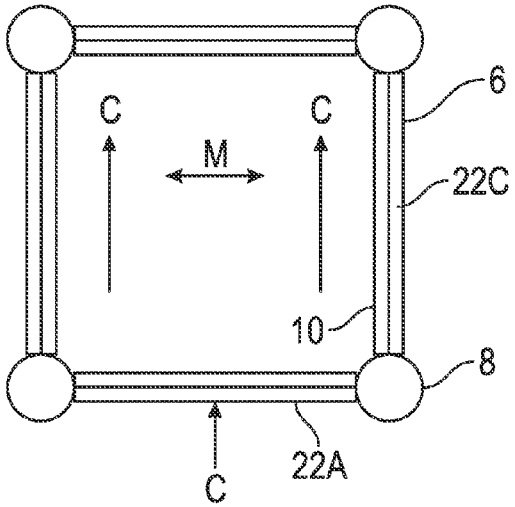
FIG. 1D is a schematic top cross sectional view of the offshore platform with the tangential side plates coupled to the truss of the offshore platform showing VIV movement of the platform generally traverse to the current flow.
Figure 1E:
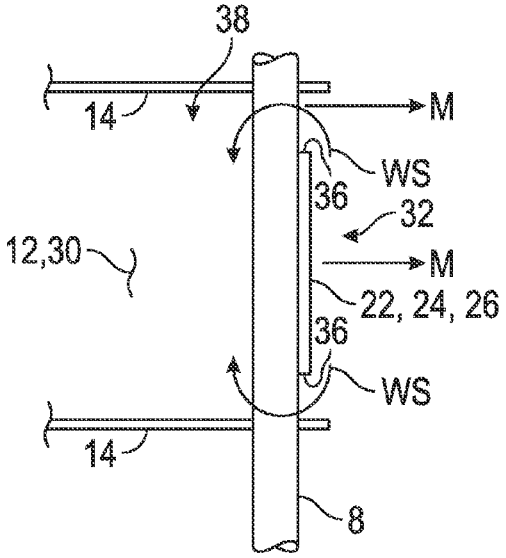
FIG. 1E is a schematic side partial cross sectional view of the offshore platform with the tangential side plates coupled to the truss of the offshore platform showing water separation over the tangential side plates for resistance of movement and reduction of the VIV movement.

FIG. 1A is a schematic front view of an offshore platform with at least one tangential side plate in a lateral orientation coupled to a truss of the platform and configured to reduce vortex-induced vibration (VIV), according to the disclosure herein. FIG. 1B is a schematic side view of the offshore platform shown in FIG. 1A with at least one side plate. FIG. 1C is a schematic top cross sectional view of the offshore platform with the tangential side plates coupled to the truss of the offshore platform. FIG. 1D is a schematic top cross sectional view of the offshore platform with the tangential side plates coupled to the truss of the offshore platform showing VIV movement of the platform generally traverse to the current flow. FIG. 1E is a schematic side partial cross sectional view of the offshore platform with the tangential side plates coupled to the truss of the offshore platform showing water separation over the tangential side plates for resistance of movement and reduction of the VIV movement. The figures will be described in conjunction with each other.

An offshore platform 2 can be any shape and size and is shown for illustrative purposes as a spar-style offshore platform. The offshore platform generally has a hull that is capable of floatation and a structure submerged between a water surface 50 for the body stabilization to the platform. In the exemplary embodiment, the offshore platform 2 includes a hull 4 with a truss 6 coupled to the bottom of the hull and extending deep into the water with the platform having a longitudinal axis 46 along the length of the platform and generally aligned vertically when the offshore platform is in an operational position. The truss is an "open" structure in that water can flow therethrough, past the columns 8 and braces 10 that form the structure. The open space is generally labeled 12 with specific areas noted as 12A, 12B, and so forth for illustrative purposes. One or more horizontal heave plates 14 are disposed laterally across the truss and separated vertically from each other to define a truss bay 16 with an open space 12 laterally between the columns 8 and longitudinally (generally vertically) between the two heave plates to define a bay square area. The heave plates 14 entrap water across the surface of the heave plates and dampen vertical movement of the offshore platform 2 due to wave action and other vertically displacing current movement. A keel 18 is located generally at the bottom of the offshore platform 2. The keel 18 is generally an enclosed area that is sometimes capable of buoyancy adjustment. The keel 18 helps provide stability to the platform with a lower center of weight due to the ballast materials that are held within the keel. While the heave plates 14 and the keel 18 provide a measure of stability, the transverse movement of the offshore platform can still cause operational and structural disruption to the platform. The hull has a diameter D and the truss has a width $W_T$ with a diagonal dimension oftentimes approximately equal to the diameter D. The length of the hull for illustrative purposes is shown as $L_H$, the length of the truss is shown as $L_T$, and the overall length is shown as $L_O$.

More specifically, in the illustrative embodiment, the truss has four truss bays 16A, 16B, 16C, 16D that are separated by three heave plates 14A, 14B, 14C. An open space 12A between the bottom of the hull 4 and heave plate 14A allows current flow of water to flow through the bay 16A. An open space 12B between the heave plate 14A and heave plate 14B allows the water flow to flow through the truss bay 16B, an open space 12C between heave plate 14B and heave plate 14C allows the current of water to flow through the truss bay 16C, and the open space 12D allows the water to flow through the truss bay 16D between the heave plates 14C and the keel 18. In FIG. 1A, two tangential side plates 22A, 22B are shown having a length of the plate $L_P$ and a width of the plate $W_P$. The side plates 22 are generally disposed tangentially around the periphery of the truss, that is, on one or more faces 48 of the truss, such as face 48A. In this embodiment, the tangential side plates 22 are laterally oriented, that is, the longer length $L_P$ is across the truss bay and the width $W_P$ is aligned longitudinally. The shape of the side plates are illustrative and other shapes, such as round, elliptical, polygonal, and other geometric and non-geometric shapes and sizes can be used.

The tangential side plates 22 cause separation of water across the edges 36 of the plates as the platform moves back and forth during VIV movement that is generally transverse to current flow around the hull 4 or through the truss 6 of the platform. Further, for those embodiments having heave plates 14, the side plates, such as side plate 22A, can cover a portion of the open area 12, so that the water separation WS occurs around the tangential side plates and flows through the open area 12 of the truss bay between the heave plates, such as truss bay 16B. In the embodiment shown in FIG. 1A, the tangential side plates 22 are located in the second and third truss spaces 16B, 16C. However, the side plates 22 can be located in other bays as may be preferred for the particular application and such example is nonlimiting.

In at least one embodiment, the side plates 22 can cover at least 25% of the bay square area of the truss bays between the heave plates. Further or instead of, the tangential side plates are sized for a width $W_P$ of at least 5% of a diameter D of the hull and a length $L_P$ of at least 15% of the diameter of the hull. By a different metric, the tangential heave plates can be sized to reduce VIV in the offshore platform by at least 50% of a VIV in the offshore platform without the tangential side plates and more advantageously at least 90%. However, the sizes can vary. For example, the size of a tangential side plate can be substantially larger, but generally less than the full bay square area to allow the separated water to flow around the edges of the side plate. As another example of the various sizes, the plate can be sized so that the amount of VIV reduction can be 20% to 100% and any fraction or any increment therebetween, such as 50, 55, 60, 65 and so forth percent and any further increments in between such values such as 51%, 52%, 53%, 54% and likewise for each of the other percentages. In at least one embodiment and merely for illustration, and without limitation, the length of the hull can be 200 feet (61 m), the length of the truss $L_T$ can be 300 feet (91 m), and the total overall height $L_O$ can be 500 feet (152 m). Further, the length (height when operational disposed vertically) of the bay $L_B$ can be 75 feet (23 m) and the width of the truss $W_T$ (and the width of the bay) can be 70 feet (71 m) for a diameter D of the hull of approximately 100 feet (30 m). The length of the plate $L_P$ can be about 65 feet (20 m) and the width $W_P$ can be about 30 feet (9 m), although other widths are possible, such as 40 feet (12 m) and 50 feet (15 m). These exemplary dimensions and proportions result in the length of the plate being 65% (65/100) and the width of the plate being 30% (30/100) and the square area of the plate being 37% of the bay square area ((65×30)/(75×70)).

Further, as shown in FIG. 1B, additional side plates 22 can be mounted to other faces 48 of the offshore platform 2, such as face 48B. In at least one embodiment, the plates 22 are mounted to all faces of the offshore platform. The mounting of all faces, or at least opposite faces, allows the plates to separate water along a plurality of plate edges and in multiple directions of current flow that helps reduce the VIV.

Referring to FIGS. 1C-1E, the tangential side plate having a thickness $T_P$ is coupled to the truss 6, such as to the braces 10, that are disposed between the columns 8. The tangential side plates 22, such as side plates 22A, 22E can separate water having the direction shown of the current flow C. On a more detailed level, the water from the current flow C is separated at the face 32 of the side plates, such as when the platform moves in the direction M of FIG. 1E, so that the separated water flows around an edge 36 of the plate 22 (plates 24, 26 as described below in other embodiments). The water separation provides a resistive force that reduces the VIV motion that would occur without the tangential side plates.

The tangential side plate 22 has a thickness $T_P$ that is generally significantly less than the width $W_P$ and length $L_P$, as would be understood to those with ordinary skill in the art. For example, and without limitation, the $T_P$ should be generally understood to be less than 10% of the width $W_P$ or the length $L_P$. Further, the side plate 22 can be disposed laterally, so that the length $L_P$ is lateral to the longitudinal axis 46. The side plate 22 can extend laterally to the columns 8. Alternatively, the side plate 22 may not extend as far as the columns to allow water flow to pass by the lateral edge of the side plate 22 between the column and the side plate. In at least one embodiment, the side plates can be positioned toward a longitudinal middle of the truss bay 16, so that there is an open area above and below the side plate 22 for the water separation to occur and the water to pass therethrough.

Figure 2A:
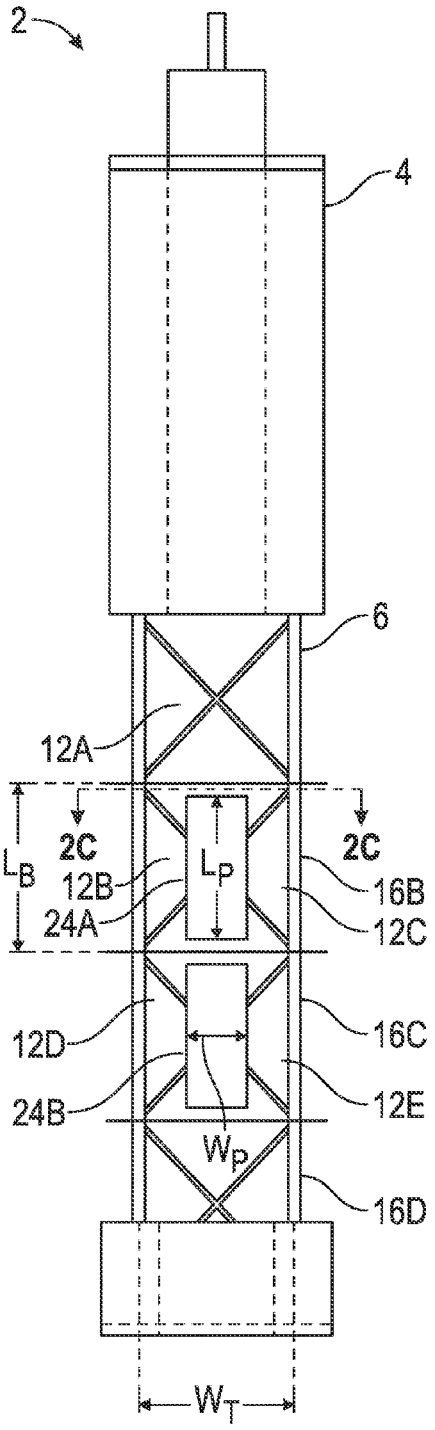
FIG. 2A is a schematic front view of another embodiment of the offshore platform with at least one tangential side plate in a longitudinal orientation coupled to a truss of the platform and configured to reduce VIV.
Figure 2B:
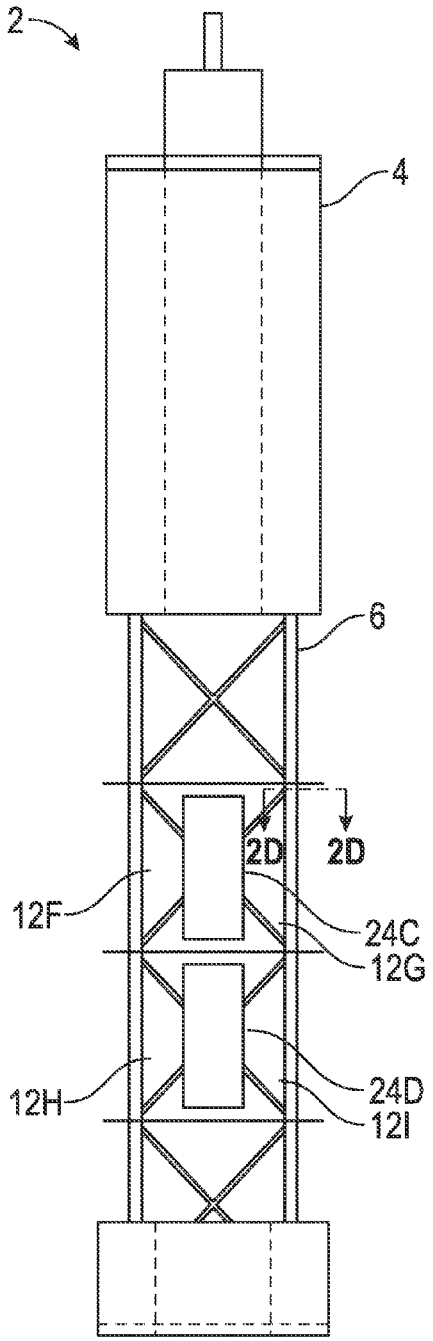
FIG. 2B is a schematic side view of the offshore platform shown in FIG. 2A with at least one tangential side plate.
Figure 2C:
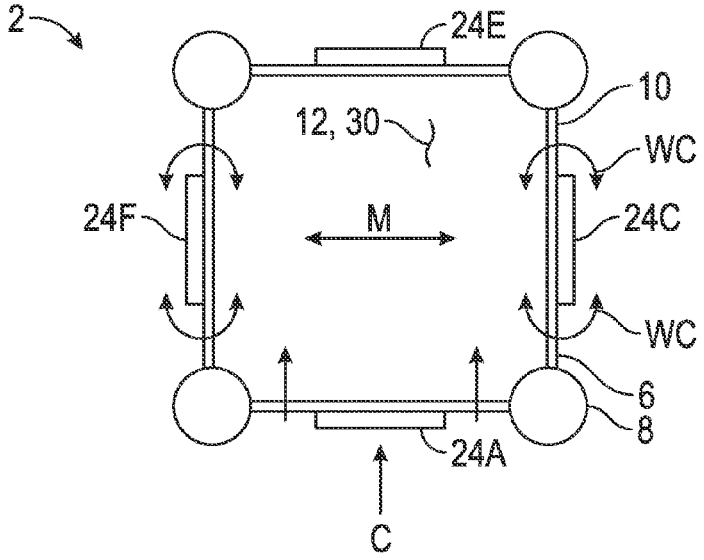
FIG. 2C is a schematic top partial cross sectional view of the offshore platform with the tangential side plates coupled to the truss of the offshore platform.
Figure 2D:
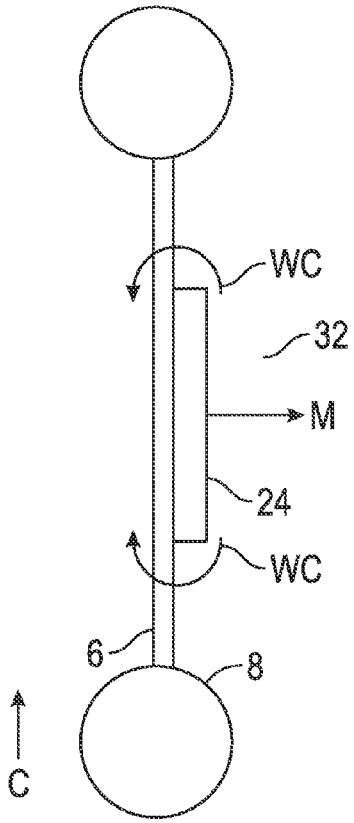
FIG. 2D is a schematic top cross sectional view of the offshore platform with the tangential side plates coupled to the truss of the offshore platform showing water separation over the side plates for resistance of movement and reduction of the VIV movement.

FIG. 2A is a schematic front view of another embodiment of the offshore platform with at least one tangential side plate in a longitudinal orientation coupled to a truss of the platform and configured to reduce VIV. FIG. 2B is a schematic side view of the offshore platform shown in FIG. 2A with at least one tangential side plate. FIG. 2C is a schematic top partial cross sectional view of the offshore platform with the tangential side plates coupled to the truss of the offshore platform. FIG. 2D is a schematic top cross sectional view of the offshore platform with the tangential side plates coupled to the truss of the offshore platform showing water separation over the side plates for resistance of movement and reduction of the VIV movement. The figures will be described in conjunction with each other.

The embodiments shown in FIGS. 2A-2D of the offshore platform 2 are generally configured similarly to the embodiment shown in FIGS. 1A-1E, except the side plates are oriented longitudinally rather than laterally. In this configuration, the side plate is designated by the number 24 in the drawings to distinguish the orientation from the side plate 22 in FIGS. 1A-1D, although the similar discussion and effects would apply in a similar way to the embodiment shown in FIGS. 2A-2D. In this embodiment, the length $L_B$ of the truss bay is a few feet longer than the length $L_P$ of the plate. For example, the truss bay length $L_B$ can be 75 feet (23 m) and the length $L_P$ of the side plate can be 70 feet (21 m).

In at least one embodiment, the tangential side plates 24A, 24C, 24E, 24F oriented longitudinally can be disposed around all faces of the truss, as shown in FIG. 2C. The water can be separated around the side plates, such as side plates 24A, 24E when the current flow C is from the direction shown in FIG. 2C (and around side plates 24C, 24F when the current direction is from left or right of the FIG. 2C). It is understood that different angles of current flow C could separate the water flow in combinations of plates such as plates 24A, 24C and 24E, 24F, when the flow is 45 degrees or other angles to the direction of the current flow C shown in FIG. 2C.

Figure 3:
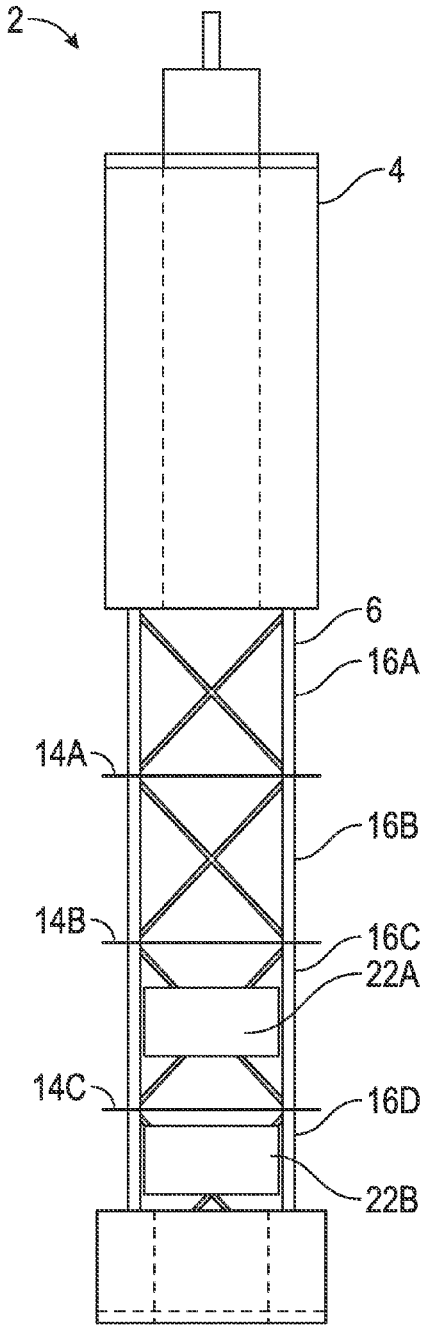
FIG. 3 is a schematic front view of another embodiment of the offshore platform with at least one lateral tangential side plate coupled to a truss of the platform at a lower elevation than shown in FIG. 1A and configured to reduce VIV.

FIG. 3 is a schematic front view of another embodiment of the offshore platform with at least one tangential side plate 22B in a lateral orientation coupled to a truss 6 of the platform 2 at a lower elevation than shown in FIG. 1A and configured to reduce VIV. The configuration is similar with one or more lateral side plates as shown in FIGS. 1A-1E. However, the side plates 22A, 22B in FIG. 3 are moved longitudinally downward into the bays 16C, 16D compared to side plates in FIGS. 1A-1E. The embodiment is only exemplary to show that the tangential side plates can be disposed at various bays, as may be appropriate for the particular configuration performance desired.

Figure 4:
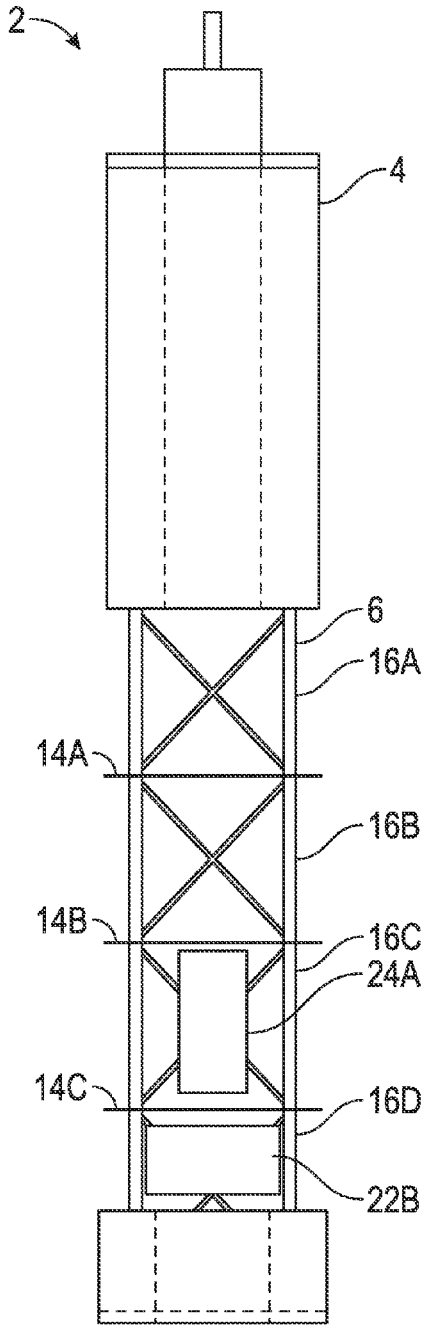
FIG. 4 is a schematic front view of another embodiment of the offshore platform with at least one tangential side plate in a lateral orientation and at least one tangential side plate in a longitudinal orientation configured to reduce VIV.

FIG. 4 is a schematic front view of another embodiment of the offshore platform with at least one tangential side plate 22 in a lateral orientation and at least one tangential side plate 24 in a longitudinal orientation configured to reduce VIV. As further shown, the orientations of the tangential side plates do not need to be uniform. For example, one or more of the side plates 22, 24 on one or more of the sides of the truss (or the hull as shown in FIGS. 5A, 5B-5C, 6) can be disposed laterally or longitudinally, including a combination of side plates both laterally or longitudinally. Even further, the side plates can be disposed in nonadjacent bays. For example, a side plate could be in bay 16A and another side plate could be in bay 16C or 16D.

Figure 5A:
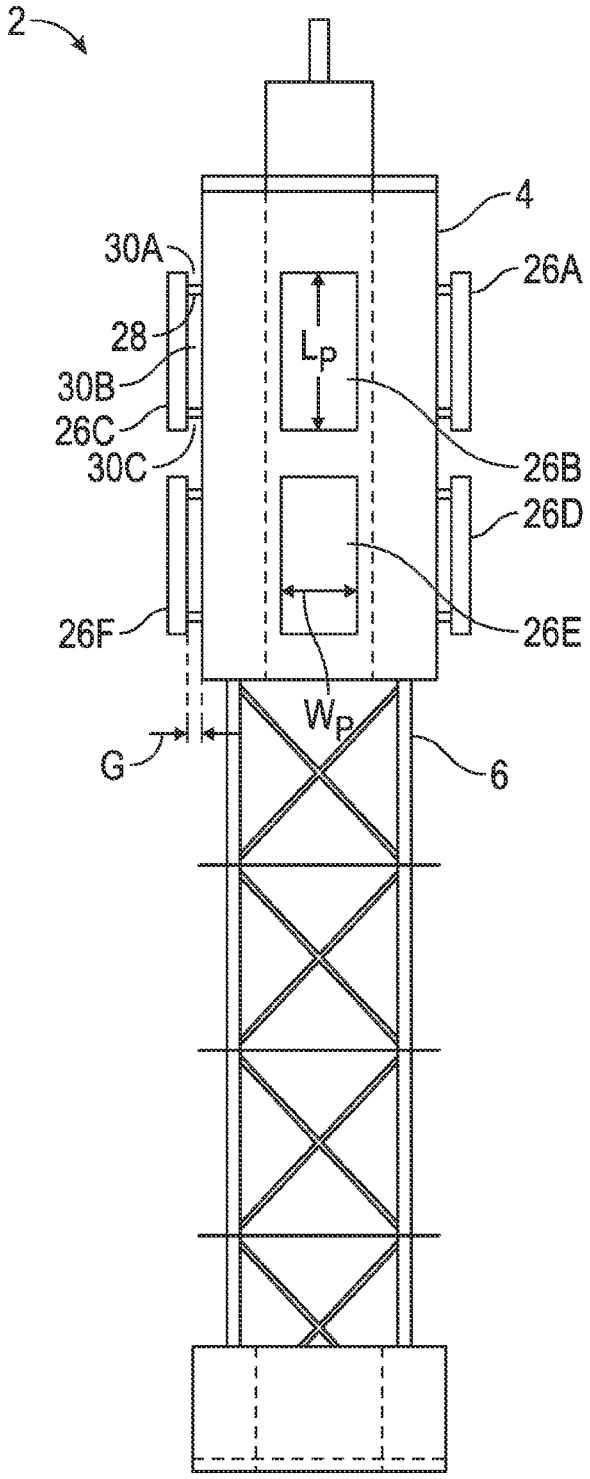
FIG. 5A is a schematic front view of another embodiment of the offshore platform with at least one tangential side plate coupled to a periphery of a hull of the platform and configured to reduce VIV, according to the disclosure herein.
Figure 5B:
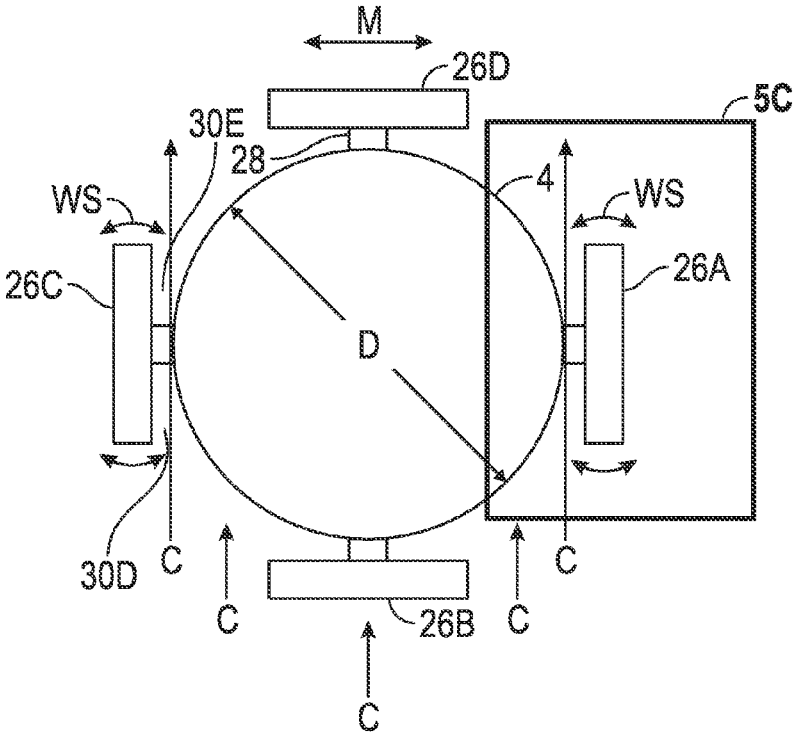
FIG. 5B is a schematic top cross sectional view of the offshore platform with tangential side plates coupled to the periphery of the hull of the offshore platform showing water separation over the side plates for resistance of movement and reduction of the VIV movement.
Figure 5C:
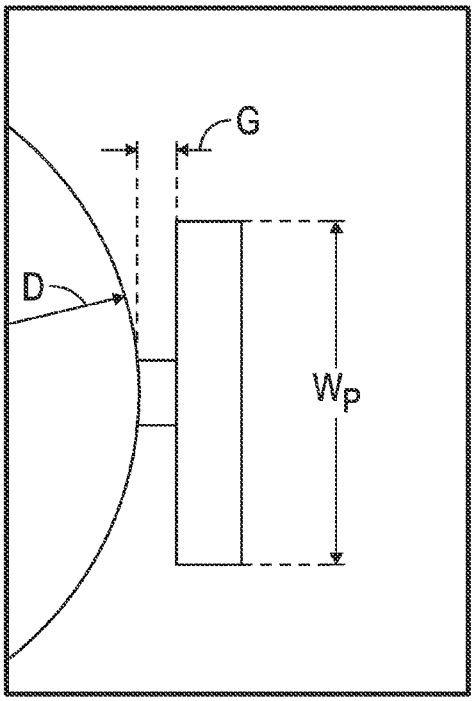
FIG. 5C is a schematic enlargement of a portion of FIG. 5B.

FIG. 5A is a schematic front view of another embodiment of the offshore platform with at least one tangential side plate coupled to a periphery of a hull of the platform and configured to reduce VIV, according to the disclosure herein. FIG. 5B is a schematic top cross sectional view of the offshore platform with tangential side plates coupled to the periphery of the hull of the offshore platform showing water separation over the side plates for resistance of movement and reduction of the VIV movement. FIG. 5C is a schematic enlargement of a portion of FIG. 5B. The figures will be described in conjunction with each other. The embodiment of the offshore platform 2 shown in FIGS. 5A, 5B-5C illustrates tangential side plates 26 coupled to the hull 4, but separated from the hull by a gap G between the side plate 26 and the periphery of the hull 4, which forms an open space 30. The tangential side plates 26 can have similar design and purpose as has been described regarding the side plates 22, 24 on the face(s) of the truss. A coupler 28, such as a beam, plate, or other structure, can hold the tangential side plates 26 in position with the hull 4. The gap G can vary and in at least one embodiment can be at least 5% of the diameter D of the hull 4.

The principle of the side plates 26 with the hull 4 is similar to the concepts described above for the side plates 22, 24 and the truss 6. An open space 30 is created between the hull and the side plate that allows water to be separated around an edge 36 of the side plates as the platform moves generally transversely to a current flow with VIV movement to help resist such transverse motion and reduce the VIV. In at least one exemplary embodiment, the side plates 26A, 26B, 26C shown in FIG. 5A can be circumferentially aligned in a row around the periphery of the hull 4. Other side plates, such as side plates 26D, 26E, 26F, can be aligned in another circumferential row. Further, it is expressly contemplated that one or more side plates 22, 24 can also be disposed on the truss 6, such as shown in FIGS. 1A through 1D and FIGS. 2A through 2C, in combination with one or more side plates 26 disposed on the hull, as shown in FIGS. 5A-6.

Figure 6:
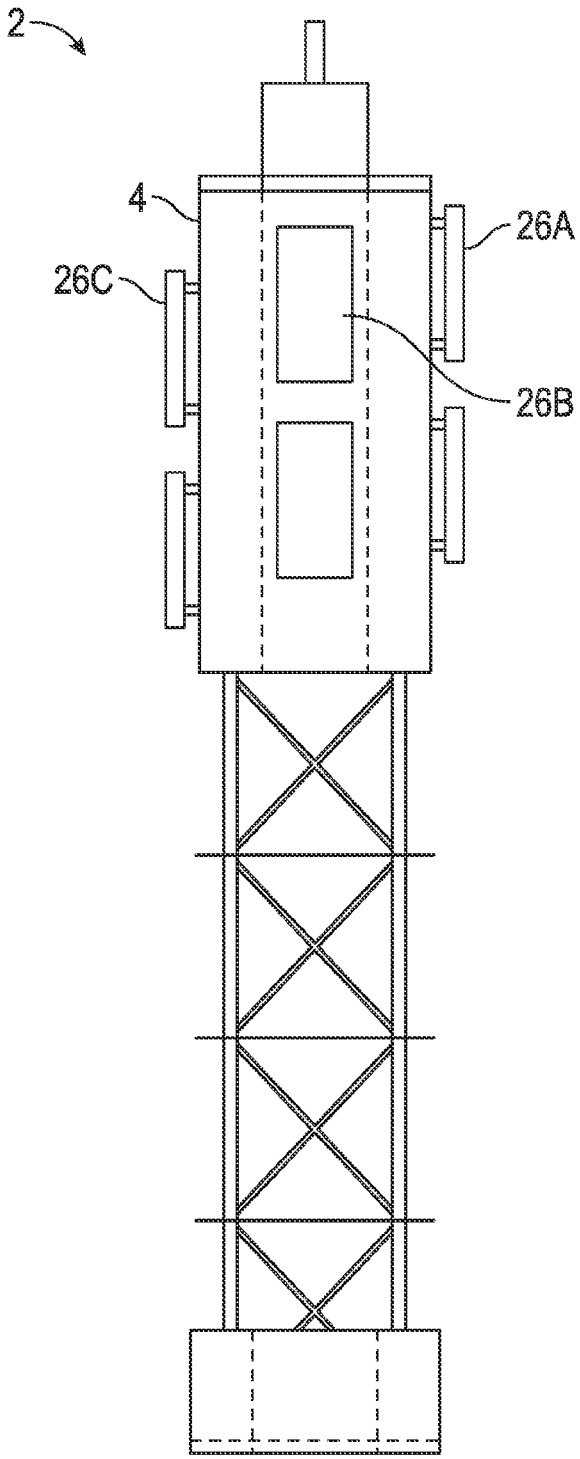
FIG. 6 is a schematic front view of another embodiment of the offshore platform with at least one tangential side plate coupled to a hull of the platform and configured to reduce VIV, according to the disclosure herein.

FIG. 6 is a schematic front view of another embodiment of the offshore platform with at least one tangential side plate coupled to a hull of the platform and configured to reduce VIV, according to the disclosure herein. The sides plates 26 are similar to the side plates shown in FIGS. 5A, 5B-5C, but in this embodiment can be aligned in one or more helical rows around the periphery of the hull 4.

Figure 7:
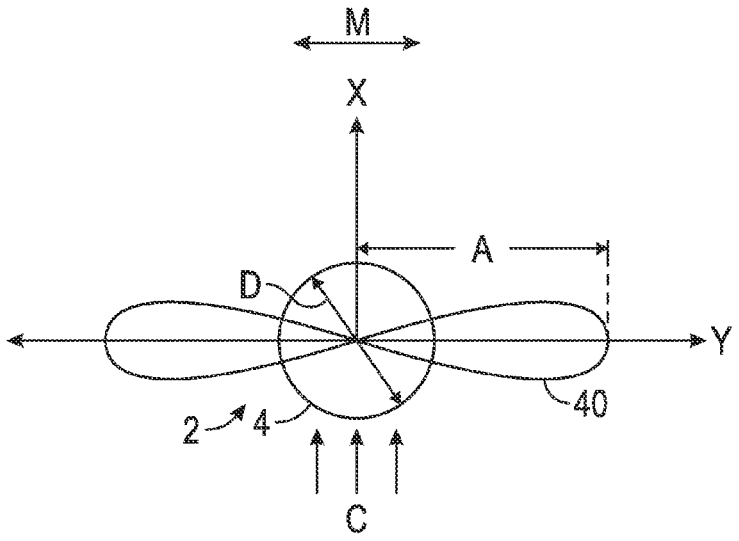
FIG. 7 is a schematic top view of an offshore platform with a representation of an amplitude of transverse and inline movement of the platform from VIV.

FIG. 7 is a schematic top view of an offshore platform with a representation of an amplitude of transverse and inline movement of the platform from VIV. In FIG. 7, the offshore platform 2 with its hull 4 can move in direction M transversely to the current flow C from the VIV movement for a given diameter D that passes through an origin of orthogonal X-Y axes in a horizontal plane. The platform 2 can move with VIV by an amplitude A along a generally transverse path outlined as path 40 from the center line of the diameter D of the hull 4. The furthest extent along the axis in any direction is known as amplitude A of the movement. The diameter D and amplitude of movement A factor into calculations and charts, such as shown in FIGS. 8 and 9 below.

Figure 8:
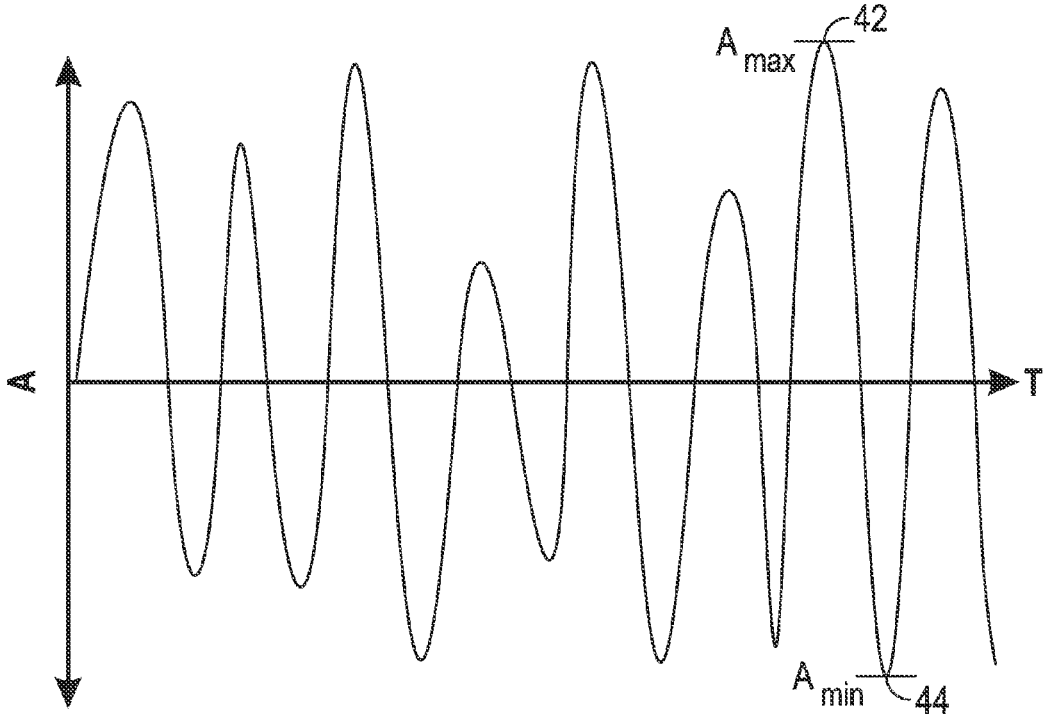
FIG. 8 is a schematic graph of the amplitude of transverse movement of the platform over a period in time.
Figure 9:
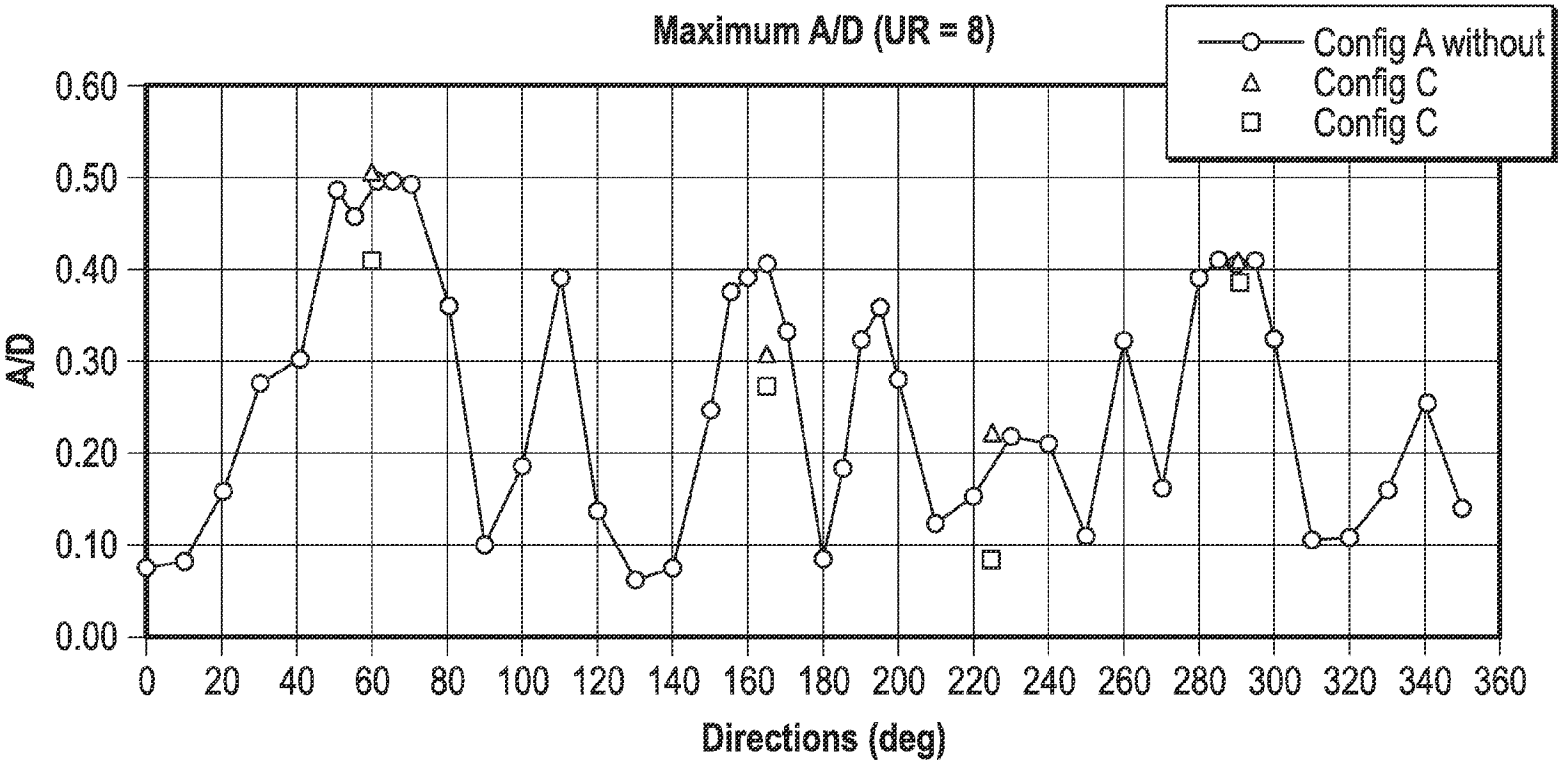
FIG. 9 is a schematic graph of three exemplary tests of VIV movement of the offshore platform for scenarios without the tangential side plates, with tangential side plates in a lateral orientation, and with tangential side plates in a longitudinal orientation at various headings of current flow against the plates.

FIG. 8 is a schematic graph of the amplitude of transverse movement of the platform over a period in time. The amplitude of movement of the platform 2 shows that it moves from a negative Y-axis position to a positive Y-axis position back and forth in an oscillating fashion, relative to the X-Y axes shown in FIG. 7. A generally known measurement parameter of VIV is to measure the ratio of the change in amplitude over the diameter of the hull.

Thus, for example, as shown in FIG. 8, a maximum amplitude shown as $A_{MAX}$ at point 42 can be compared to the minimum amplitude $A_{MIN}$ at point 44 of the curve. The difference in amplitude is the maximum amplitude minus the minimum amplitude and that amount can be divided by twice the diameter D of the hull 4. The formula is generally given as:

$$(A_{MAX}-A_{MIN})/2D$$

and is represented simply by "A/D."

FIG. 9 is a schematic graph of three exemplary tests of VIV movement of an offshore platform for scenarios without the tangential side plates, with tangential side plates in a lateral orientation, and with tangential side plates in a longitudinal orientation at various headings of current flow against the plates. FIG. 9 shows a ratio of A/D plotted with a continuous curve of a configuration without any tangential side plates compared to a configuration with laterally-oriented side plates and a third configuration with longitudinally-oriented side plates. A lower value along the Y-axis of A/D points to a lower VIV. The X-axis represents the heading of current flow that would impact the platform and therefore the plates relative to that heading. The second and third configurations are measured in four different headings as exemplary input for comparison, namely, 60°, 165°, 225°, and 290°. The biggest difference between the configurations without side plates and the configuration with laterally oriented side plates occurs at about 165°. Further, at a 225° heading, the configuration with the longitudinally oriented side plates has the biggest difference between both the configuration without side plates and the configuration with laterally oriented side plates.

Other and further embodiments utilizing one or more aspects of the invention described above can be devised without departing from the spirit of the invention. For example, various numbers of sides and shapes and sizes of open structures, such as a truss, can be used, and various shapes and sizes of hulls can be used. The length and width and depth of the plates can vary, as well as the number of plates. Other variations in the system are possible.

Further, the various methods and embodiments described herein can be included in combination with each other to produce variations of the disclosed methods and embodiments. Discussion of singular elements can include plural elements and vice-versa. References to at least one item followed by a reference to the item may include one or more items. Also, various aspects of the embodiments could be used in conjunction with each other to accomplish the understood goals of the disclosure. Unless the context requires otherwise, the word "comprise" or variations such as "comprises" or "comprising," should be understood to imply the inclusion of at least the stated element or step or group of elements or steps or equivalents thereof, and not the exclusion of a greater numerical quantity or any other element or step or group of elements or steps or equivalents thereof. The device or system may be used in a number of directions and orientations. The term "coupled," "coupling," "coupler," and like terms are used broadly herein and may include any method or device for securing, binding, bonding, fastening, attaching, joining, inserting therein, forming thereon or therein, communicating, or otherwise associating, for example, mechanically, magnetically, electrically, chemically, operably, directly or indirectly with intermediate elements, one or more pieces of members together and may further include without limitation integrally forming one functional member with another in a unitary fashion. The coupling may occur in any direction, including rotationally.

The order of steps can occur in a variety of sequences unless otherwise specifically limited. The various steps described herein can be combined with other steps, interlineated with the stated steps, and/or split into multiple steps. Similarly, elements have been described functionally and can be embodied as separate components or can be combined into components having multiple functions.

The invention has been described in the context of preferred and other embodiments and not every embodiment of the invention has been described. Apparent modifications and alterations to the described embodiments are available to those of ordinary skill in the art given the disclosure contained herein. The disclosed and undisclosed embodiments are not intended to limit or restrict the scope or applicability of the invention conceived of by the Applicant, but rather, in conformity with the patent laws, Applicant intends to protect fully all such modifications and improvements that come within the scope or range of equivalent of the following claims.

What is claimed is:

1. A system for reducing vortex-induced-vibration (VIV) in an offshore platform, comprising:

an offshore platform having a hull;

a truss of the offshore platform configured to be at least partially submerged below a surface of water, the water having a current flow, the truss defining a truss bay square area; and one or more side plates tangentially coupled around a periphery of the truss, the one or more tangential side plates having less square area than the truss bay square area, at least one of the side plates positioned on the truss to form an open space for water and being configured to allow the water to flow around at least two edges of the at least one of the side plates and cause water separation around the at least two edges when the offshore platform moves transversely to the current flow and reduce VIV in the offshore platform compared to a VIV in the offshore platform without the tangential side plates.

2. The system of claim 1, wherein the side plates sized are configured to reduce VIV in the offshore platform by at least 20% of a VIV in the offshore platform without the tangential side plates.

3. The system of claim 1, wherein the at least one of the tangential side plates for a given truss bay are sized for a width of at least 5% of a diameter of the hull and a length of at least 15% of the diameter of the hull.

4. The system of claim 1, wherein the truss forms a plurality of sides and at least one tangential side plate is coupled to each of two opposing sides of the truss with an open space for water therebetween.

5. The system of claim 1, further comprising at least two heave plates disposed laterally across a face of the truss and separated longitudinally from each other for the truss bay.

6. The system of claim 5, wherein the at least one tangential side plate defines a square area that is at least 25% of the truss bay square area.

7. The system of claim 1, wherein the tangential side plates are oriented laterally, longitudinally, or a combination of lateral and longitudinally across the truss.

8. The system of claim 1, further comprising three heave plates disposed laterally across the truss and separated longitudinally from each other to define two truss bays each with a truss bay square area across the truss and between the heave plates in each truss bay, and wherein one or more of the tangential side plates are sized to cover at least 25% of the truss bay square area in each of the truss bays on at least one face of the truss.

9. The system of claim 8, wherein the tangential side plates are oriented laterally, longitudinally, or a combination of laterally and longitudinally across the at least one face of the truss.

10. A system for reducing vortex-induced-vibration (VIV) in an offshore platform, comprising:

an offshore platform having a hull, the hull having a diameter;

a truss of the offshore platform configured to be at least partially submerged below a surface of water, the water having a current flow, the truss forming a truss bay with an area through which the water can flow; and one or more tangential side plates tangentially coupled around a periphery of the truss, the one or more side plates having less square area than the truss bay area, at least one of the side plates positioned on the truss to form an open space for water and being configured to allow the water to flow around at least two edges of the at least one of the side plates and cause water separation around the at least two edges when the offshore platform moves transversely to the current flow, the at least one of the side plates for a given truss bay being sized for a width of at least 5% of the diameter and a length of at least 15% of the diameter.

11. The system of claim 10, wherein the tangential side plates are configured to reduce VIV in the offshore platform by at least 20% of a VIV in the offshore platform without the side plates.

12. A method for reducing vortex-induced-vibration (VIV) in an offshore platform, having an offshore platform with a hull; a truss of the offshore platform configured to be at least partially submerged below a surface of water, the water having a current flow, the truss defining a truss bay square area; and one or more side plates tangentially coupled around a periphery of the truss, the one or more side slates having less square area than the truss bay area, at least one of the side plates positioned on the truss to form an open space for water to flow around at least two edges of the at least one of the side plates, comprising:

separating water flow around the at least two edges of the at least one of the side plates when the offshore platform moves transversely relative to the current flow;

generating resistance to the transverse motion on the truss with the water separation; and reducing the VIV in the offshore platform compared to a VIV in the offshore platform without the plates.

13. The method of claim 12, further comprising reducing transverse movement of the offshore platform with the tangential side plates.

14. The method of claim 12, wherein the offshore platform comprises at least two heave plates disposed laterally across the truss and separated longitudinally from each other for the truss bay.

15. The method of claim 14, further comprising separating at least 25% of water flow through the truss bay.

* * * * *